US011202968B1

(12) United States Patent
Bellinsky

(10) Patent No.: US 11,202,968 B1
(45) Date of Patent: Dec. 21, 2021

(54) HAND TOY DEVICE

(71) Applicant: Toy Tech Corp, Manasquan, NJ (US)

(72) Inventor: Rachel Bellinsky, Henderson, NV (US)

(73) Assignee: Toy Tech Corp, Manasquan, NJ (US)

( * ) Notice: Subject to any disclaimer, the term of this patent is extended or adjusted under 35 U.S.C. 154(b) by 0 days.

(21) Appl. No.: 17/069,729

(22) Filed: Oct. 13, 2020

(51) Int. Cl.
*A63H 5/00* (2006.01)
*A63H 33/00* (2006.01)
*G10K 15/04* (2006.01)

(52) U.S. Cl.
CPC ..... *A63H 33/00* (2013.01); *G10K 15/04* (2013.01)

(58) Field of Classification Search
CPC ..... A63H 5/00; A63H 33/00; A61J 7/0007; B02C 19/08; B26D 1/26; D26D 3/30
USPC ..... 446/418–419, 397; 241/168–169.2, 199, 241/205; 199/12; 30/120.2
See application file for complete search history.

(56) References Cited

U.S. PATENT DOCUMENTS 1,366,929 A * 2/1921 Pasnik ..... A47G 19/24 222/487
1,406,589 A * 2/1922 Szigeti ..... F25C 5/043 241/199.11
1,439,259 A * 12/1922 Pasnik ..... A47G 19/24 222/510
1,506,567 A * 8/1924 Cohn ..... A63H 5/00 446/193
1,576,231 A * 3/1926 Cohn ..... A63H 5/00 446/193
2,161,998 A * 6/1939 Chott ..... B02C 19/08 241/101.3
2,318,911 A * 5/1943 Zweber ..... A61J 7/0007 241/169.1
2,643,483 A * 6/1953 Walker ..... A01M 31/004 446/397
2,683,566 A * 7/1954 Bentley ..... A47J 42/34 241/169
2,698,719 A * 1/1955 Heard ..... A47J 42/04 241/169
2,726,816 A * 12/1955 Brantley ..... A61J 7/0007 241/169.2
2,787,308 A * 4/1957 Popeil ..... B26D 3/26 241/272
2,876,956 A * 3/1959 Bentley ..... A47J 42/34 241/168
3,356,369 A 12/1967 Stubbmann
3,478,932 A * 11/1969 Phillips ..... A47G 19/24 222/192
4,152,863 A 5/1979 Kubiatowicz
4,212,430 A * 7/1980 Dale ..... B02C 7/00 241/89.4
4,366,930 A * 1/1983 Trombetti, Jr. ..... A61J 7/0007 241/169
4,397,425 A * 8/1983 Moore ..... B02C 19/08 241/169.1

(Continued)

*Primary Examiner* — Eugene L Kim
*Assistant Examiner* — Matthew B Stanczak
(74) *Attorney, Agent, or Firm* — Patterson + Sheridan, LLP

(57) ABSTRACT

A hand toy device is described that when manipulated, emits a distinct sound and provides a tactile response. The hand toy device includes a cover over a pan containing a granular and/or other sound-generating material, a plunger movable to contact and displace the sound-generating material, and a biasing member configured to bias the plunger away from the sound-generating material.

20 Claims, 5 Drawing Sheets

(56) References Cited

U.S. PATENT DOCUMENTS 4,967,970 A * 11/1990 Michel ..... B26D 3/26 241/169
5,063,912 A 11/1991 Hughes
5,082,190 A 1/1992 Chen
5,215,038 A 6/1993 O'Rourke
5,632,450 A * 5/1997 Moor ..... A47J 43/00 241/100
6,227,927 B1 * 5/2001 Smith ..... A63H 5/00 446/192
6,467,711 B2 * 10/2002 Michel ..... B26D 3/26 241/169
D471,068 S 3/2003 Smiszek
6,585,179 B2 * 7/2003 Weibel ..... B26D 3/26 241/169
6,682,393 B1 * 1/2004 Puett, III ..... A63H 5/00 446/418
6,902,463 B2 * 6/2005 Vaicunas ..... A01M 31/004 446/397
7,100,854 B2 * 9/2006 Aby-Eva ..... B26D 3/26 241/169
D537,480 S 2/2007 Sullivan
7,258,292 B2 * 8/2007 Cheung ..... B26D 3/26 241/169
7,346,949 B2 3/2008 Kamrin-Balfour
8,079,593 B2 12/2011 Nicely et al.
8,162,247 B2 * 4/2012 Faulker ..... B02C 19/08 241/169.2
8,720,807 B2 * 5/2014 Priebe ..... A61J 7/0007 241/169
9,021,990 B2 5/2015 Rutherford et al.
9,668,975 B2 * 6/2017 Kuo ..... A61K 9/1635
D862,998 S 10/2019 Tu
10,709,641 B2 * 7/2020 Yang ..... B02C 23/16
10,758,454 B2 * 9/2020 Torres ..... B26D 1/26
2001/0028007 A1 * 10/2001 Michel ..... B26D 3/26 241/169
2002/0038832 A1 * 4/2002 Chen ..... A47J 42/34 241/169.1
2003/0141395 A1 7/2003 Wong et al.
2004/0069881 A1 * 4/2004 Arduini ..... A47J 42/46 241/169.1
2005/0205704 A1 * 9/2005 Yurchenco ..... A47J 43/044 241/169
2007/0215731 A1 * 9/2007 Fornage ..... A47J 42/04 241/169.1
2014/0249359 A1 9/2014 Genereux et al.

* cited by examiner

HAND TOY DEVICE

BACKGROUND

Field

Embodiments of the present disclosure generally relate to a device, such as a hand-held stress reliever, that may be manipulated in order to emit a distinct sound and provide a tactile response.

Description of the Related Art

As well as tools, devices that may be hand-held are used for purposes such as promoting mental focus, stress relief, physiotherapy, sporting activities, and amusement. Example devices include sports equipment, musical instruments, deformable balls, worry beads, and toys. Such devices are used by babies, children, and adults. Popular devices provide mental stimulation, such as through motion, color, sound, or tactile effects. The popularity of such devices waxes and wanes, and therefore there is a constant demand for new devices.

SUMMARY

The present disclosure generally relates to a hand toy device that is configured to be manipulated in order to emit a distinct sound and provide a tactile response. The hand toy device can be hand-held, and can be operated to provoke an autonomous sensory meridian response. Operating the hand toy device can provide or promote stress relief, physiotherapy, amusement, or mental focus.

In an embodiment, a hand toy device includes a pan containing a granular material. A plunger is movable between a first position in which the plunger is not in contact with the granular material and a second position in which the plunger is in contact with the granular material. A cover coupled to the pan encloses the plunger and the granular material within the hand toy device. A biasing member is configured to bias the plunger toward the first position.

In another embodiment, a hand toy device includes a pan including a trough containing a sound-generating material. A plunger is movable between a first position distal from a floor of the trough and a second position proximal to the floor of the trough. The plunger interacts with at least a portion of the sound-generating material to produce a tactile feel when the plunger moves to the second position. A cover coupled to the pan encloses the plunger and the sound-generating material within the hand toy device. A biasing member is configured to bias the plunger toward the first position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns a hand toy device that is manipulated in order to emit a distinct sound and provide a tactile response. A user may actuate the hand toy device a single time or repeatedly in order to obtain audible and tactile responses. Operating the hand toy device can provide stress relief, physiotherapy, amusement, or mental focus, all to the benefit of the user.

Figure 1:
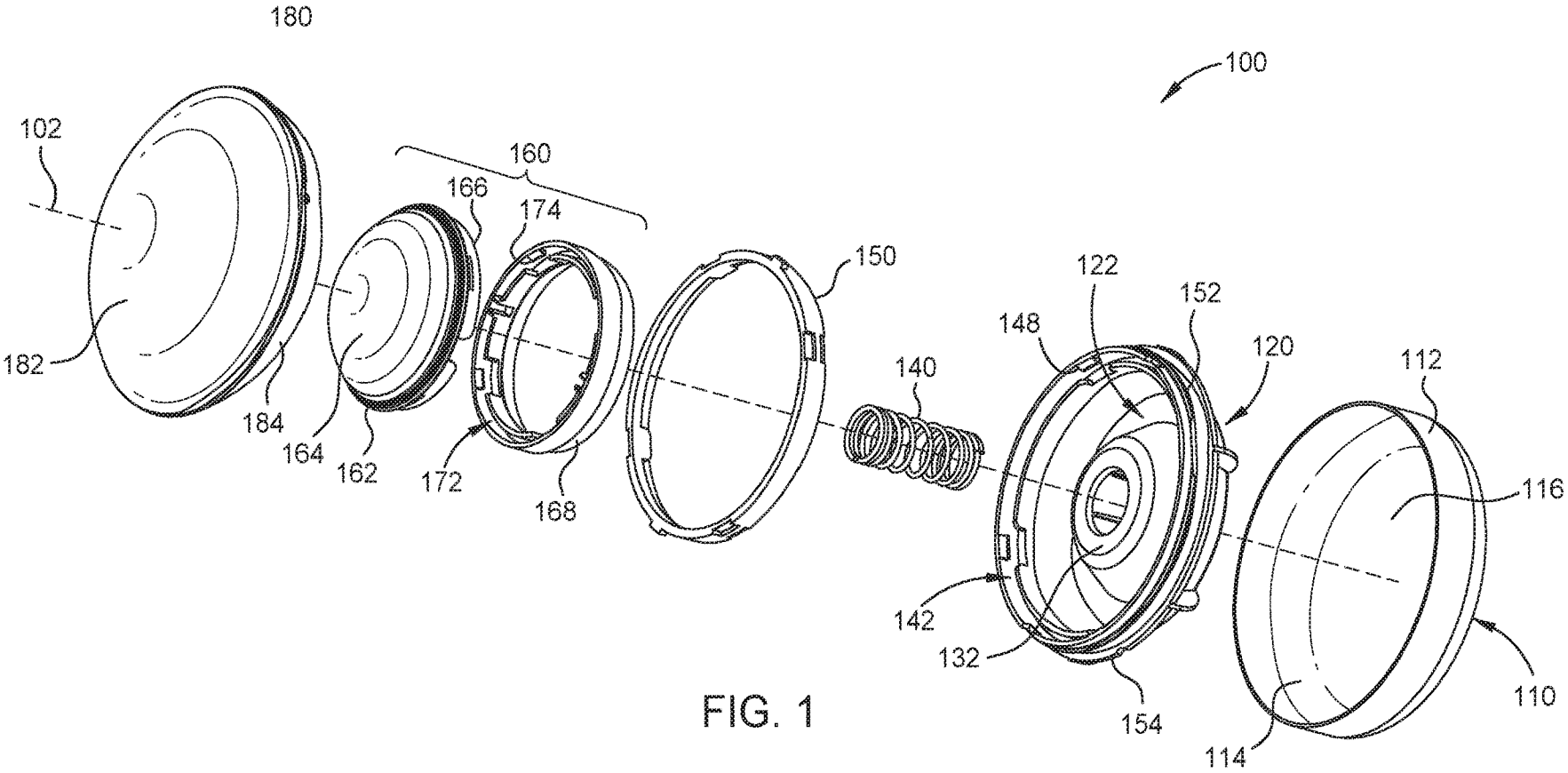
FIG. 1 is an exploded view of components of a hand toy device.
Figure 2:
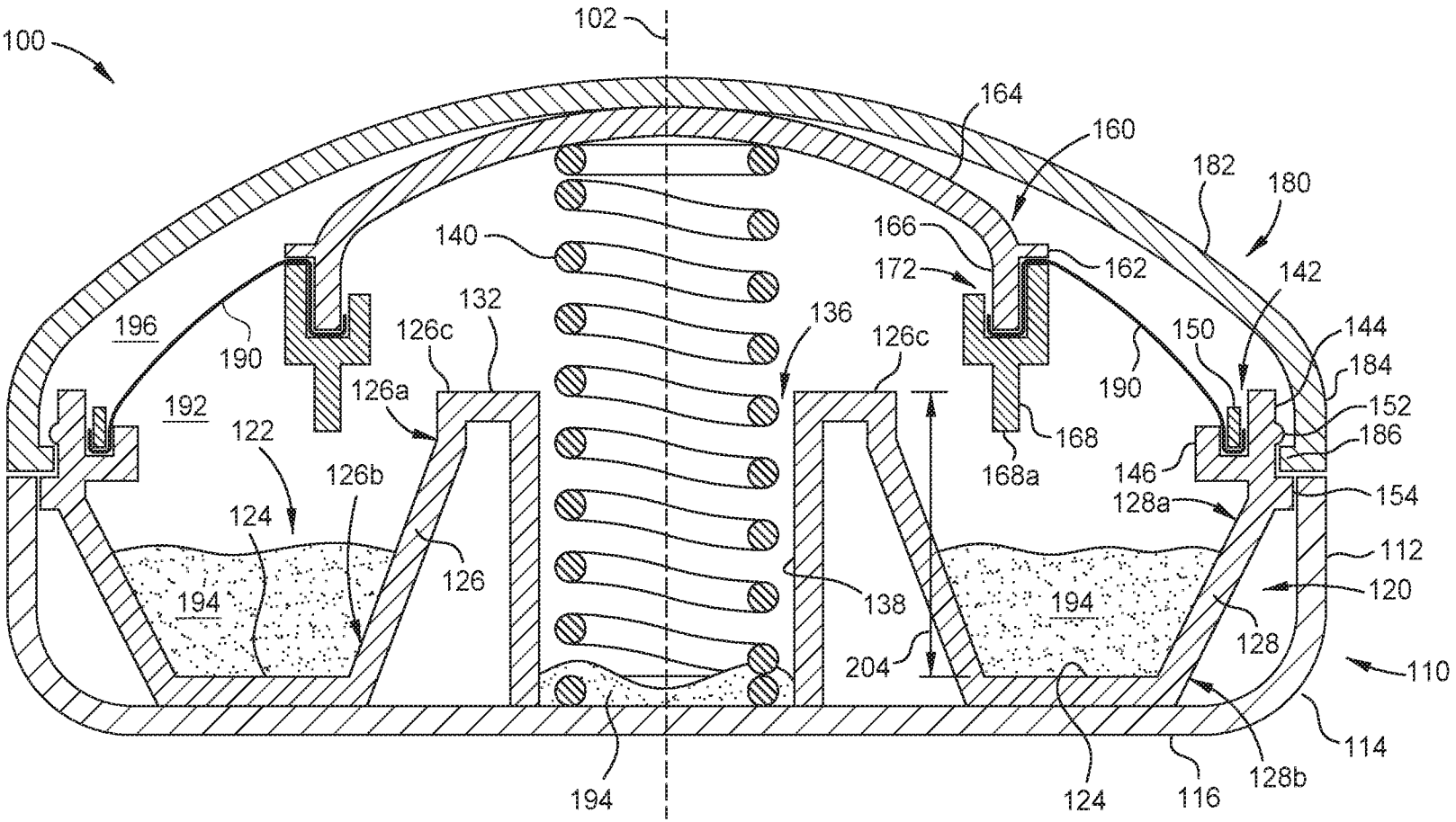
FIG. 2 is a schematic cross sectional view of the hand toy device of FIG. 1 in an assembled configuration.
Figure 3:
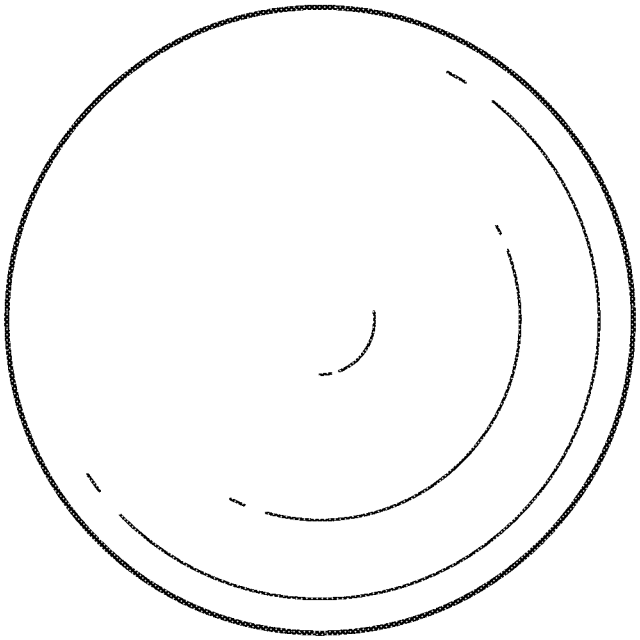
FIG. 3 is a top view of the hand toy device of FIG. 1.
Figure 4:
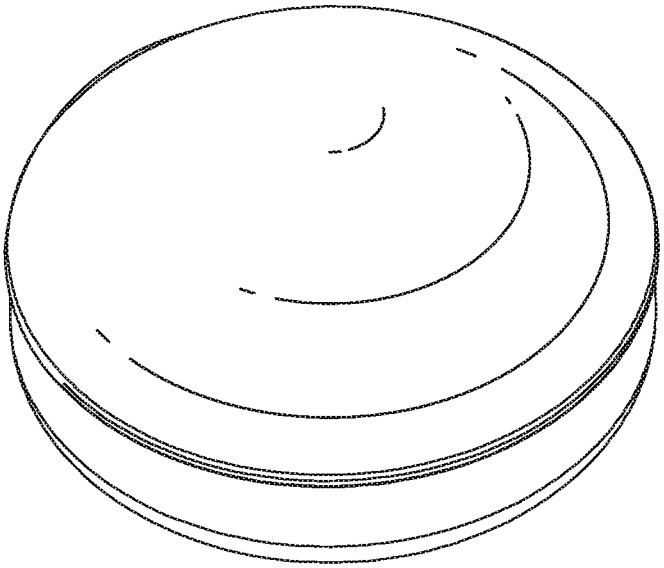
FIG. 4 is a three-quarter view of the top of the hand toy device of FIG. 1.
Figure 5:
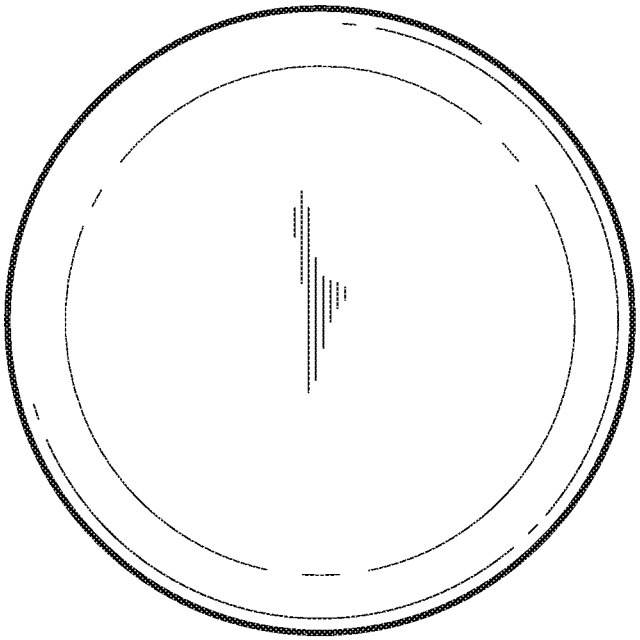
FIG. 5 is a bottom view of the hand toy device of FIG. 1.
Figure 6:
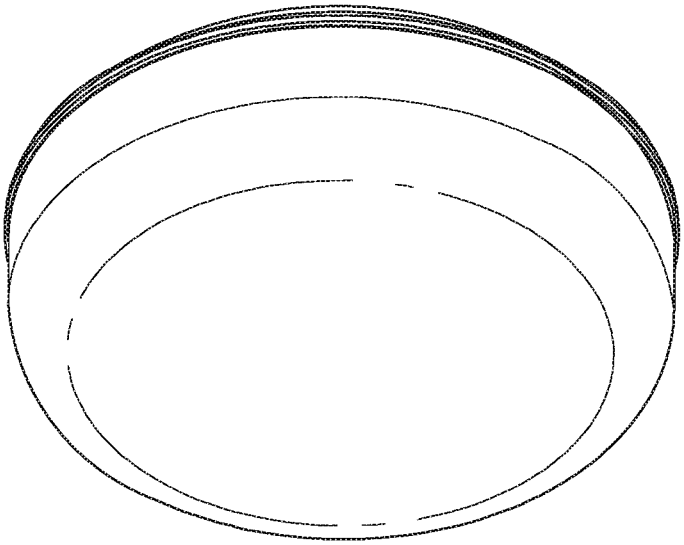
FIG. 6 is a three-quarter view of the bottom of the hand toy device of FIG. 1.
Figure 7:
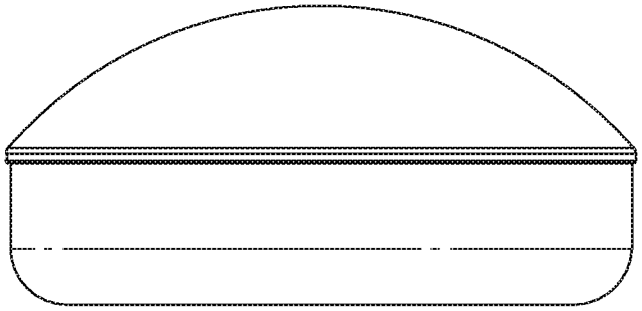
FIG. 7 is a side view of the hand toy device of FIG. 1. Other sides present mirror images thereof.

FIG. 1 is an exploded view of components of a hand toy device 100, and FIG. 2 is a schematic cross sectional view of the hand toy device 100 in an assembled configuration. The hand toy device 100 has a base 110 that includes a tubular ring 112. As shown, a transition section 114 connects the tubular ring 112 to an end plate 116. The transition section 114 is illustrated a tapering from a diameter of the tubular ring 112 as measured perpendicularly to a longitudinal axis 102 of the hand toy device 100 to a diameter of the end plate 116 that is smaller than the diameter of the tubular ring 112. In some embodiments, the transition section 114 may have a frustoconical shape. In some embodiments, the transition section 114 may have a curved profile. In some embodiments, the transition section 114 may be omitted such that the tubular ring 112 adjoins the end plate 116.

The hand toy device 100 also has a pan 120. The pan 120 includes a trough 122 having an inner sidewall 126 and an outer sidewall 128. Each of the inner sidewall 126 and the outer sidewall 128 has an upper portion 126*a*, 128*a* and a corresponding lower portion 126*b*, 128*b*. As shown, the trough 122 is annular with a longitudinal cross sectional shape that is substantially trapezoidal, whereby at least a section of the inner sidewall 126 and at least a section of the outer sidewall 128 extend at acute angles to the longitudinal axis 102 from the respective lower portions 126*b*, 128*b* at a floor 124 of the pan 120 to the corresponding upper portions 126*a*, 128*a*. Thus, a cross sectional area of the trough 122 measured in a plane perpendicular to the longitudinal axis 102 at upper portions 126*a*, 128*a* of the inner and outer sidewalls 126, 128 is greater than a cross sectional area of the trough 122 at lower portions 126*b*, 128*b* of the inner and outer sidewalls 126, 128.

In some embodiments, it is contemplated that at least a section of one of the inner sidewall 126 and the outer sidewall 128 may extend from the respective lower portion 126*b*, 128*b* to the corresponding upper portion 126*a*, 128*a* at an acute angle to the longitudinal axis 102. In some embodiments, it is contemplated that at least a section of one of the inner sidewall 126 and the outer sidewall 128 may extend from the respective lower portion 126*b*, 128*b* to the corresponding upper portion 126*a*, 128*a* in a curved profile, such as curved in a plane substantially parallel to the longitudinal axis 102 of the hand toy device 100. In some embodiments, it is contemplated that at least at least a section of one of the inner sidewall 126 and the outer sidewall 128 may extend from the respective lower portion 126*b*, 128*b* to the corresponding upper portion 126*a*, 128*a* parallel to the longitudinal axis 102. In some embodiments, it is contemplated that the inner sidewall 126 may contact the outer sidewall 128 at the floor 124, and the inner and outer sidewalls 126, 128 diverge as they extend from the lower portion 126*b*, 128*b* to the upper portion 126*a*, 128*a*.

As shown, the top 126*c* of the inner sidewall 126 is at a center section 132 of the pan 120 where there is an opening forming an entrance to a bore 136. The bore 136 has a bore wall 138 that serves as a guide for a biasing member 140, such as a spring. As shown, the biasing member 140 is configured as a coil spring, however it is contemplated that the biasing member 140 may be configured as a Belleville spring or as a body of resilient material, such as an elastomer.

As shown, an annular recess 142 is located at the upper portion 128*a* of the outer sidewall 128. The recess 142 is shown as being defined at least in part by an external wall 144 and at least in part by an internal wall 146. The recess 142 is shown as including one or more retaining features 148 configured to engage a corresponding retaining ring 150. In some embodiments, it is contemplated that the retaining features 148 may be omitted. The retaining ring 150 is shaped and sized to fit into the recess 142. It is contemplated that the retaining ring 150 may be shaped and sized to be a relatively snug fit in the recess 142. In embodiments in which the retaining features 148 are present in the recess 142, it is contemplated that the retaining ring 150 may be a snap fit in the recess 142. In some embodiments, it is contemplated that the retaining ring 150 may be adhered, or otherwise bonded, to the pan 120 at the recess 142.

An outer surface of the external wall 144 includes a lip 152. The lip 152 projects from the outer surface of the external wall 144, thereby defining an outer dimension that is greater than an outer dimension of the outer surface of the external wall 144. In some embodiments, it is contemplated that the lip 152 may extend substantially around a circumference of the external wall 144. In some embodiments, it is contemplated that the lip 152 may be formed as one or more discrete projections around a circumference of the external wall 144. The lip 152 is positioned such that a section of the external wall 144 separates the lip 152 from a shoulder 154.

The hand toy device 100 also has a plunger 160 that includes a cap 162 and a skirt 168. As shown, the cap 162 has a dome 164 and a connector 166. The connector 166 is generally annular in shape, and is configured to mate with a corresponding receptacle 172 of the skirt 168. The skirt 168 is a tubular ring with the receptacle 172 located at an upper end. The receptacle 172 is shown as including one or more retainers 174 configured to engage the connector 166. In some embodiments, it is contemplated that the retainers 174 may be omitted. The connector 166 is shaped and sized to fit into the receptacle 172. It is contemplated that the connector 166 may be shaped and sized to be a relatively snug fit in the receptacle 172. In embodiments in which the retainers 174 are present in the receptacle 172, it is contemplated that the connector 166 may be a snap fit in the receptacle 172. In some embodiments, it is contemplated that the connector 166 may be adhered, or otherwise bonded, to the skirt 168 at the receptacle 172.

As shown, a lowermost end 168*a* of the skirt 168 lies on a plane that is substantially perpendicular to the longitudinal axis 102. In some embodiments, it is contemplated that the lowermost end of the skirt 168 may include projections or other features. For example, the lowermost end of the skirt 168 may define an acute angle with respect to a plane that is perpendicular to the longitudinal axis 102. Other examples include the lowermost end 168*a* of the skirt 168 having a saw-tooth profile, castellations, or other shaped projections.

The hand toy device 100 also has a bonnet 180 that includes a cover 182 and a coupling 184. The cover 182 is flexible. In some embodiments, it is contemplated that the cover 182 may be made from a deformable material that deflects from an original shape in response to the application of a force, and returns substantially to the original shape upon removal of the applied force. For example, the cover 182 may be made from a rubber, an elastomer, a malleable plastic, or such like. It is contemplated that the cover 182 may be attached to the coupling 184 by gluing, welding, or another bonding process.

It is contemplated that any one or more of the base 110, pan 120, retaining ring 150, plunger 160, cap 162, skirt 168, and coupling 184 may be made from a material such as metal, plastic, wood, glass, ceramic, man-made or naturally occurring stone, or a composite material. It is further contemplated that any one or more of the base 110, pan 120, retaining ring 150, plunger 160, cap 162, skirt 168, and coupling 184 may be formed as two or more individual components joined together, or may be formed by 3D printing, or may be formed as a unitary component, such as by stamping, molding, casting, and/or milling a single piece of material. It is further contemplated that the base 110 and the pan 120 may be formed as a unitary component.

As discussed above, FIG. 2 illustrates the hand toy device 100 in an assembled configuration. The pan 120 is mounted to the base 110 such that the floor 124 of the trough 122 is proximate to the end plate 116 and the tubular ring 112 of the base 110 is positioned at the shoulder 154 of the pan 120. It is contemplated that the pan 120 may be joined to the base 110 by any one or more of a screw thread between the tubular ring 112 and the pan 120, an interference fit of the tubular ring 112 onto the pan 120, a snap fit of the tubular ring 112 onto the pan 120, or by bonding, such as with an adhesive, a weld, or other suitable technique. The biasing member 140 has one end resting on the end plate 116, and extends through the bore 136 of the pan 120. The biasing member 140 also extends through the skirt 168 of the plunger 160, and the other end of the biasing member 140 bears against the cap 162 of the plunger 160.

The cover 182 of the bonnet 180 encloses the plunger 160, and the coupling 184 of the bonnet 180 is positioned at the shoulder 154 of the pan 120. As shown in FIG. 2, a tang 186 of the coupling 184 is positioned between the lip 152 and the shoulder 154 of the pan 120, thereby holding the coupling 184 of the bonnet 180 in place. In some embodiments, it is contemplated that the coupling 184 may be joined to the pan 120 by any one or more of a screw thread between the coupling 184 and the pan 120, an interference fit of the coupling 184 onto the pan 120, a snap fit of the coupling 184 onto the pan 120, or by bonding, such as with an adhesive, a weld, or other suitable technique. Additionally, or alternatively, it is contemplated that the coupling 184 may be joined to the tubular ring 112 of the base 110 by any one or more of a screw thread between the coupling 184 and the tubular ring 112, an interference fit of the coupling 184 onto the tubular ring 112, a snap fit of the coupling 184 onto the tubular ring 112, or by bonding, such as with an adhesive, a weld, or other suitable technique.

Continuing to refer to FIG. 2, a diaphragm 190 extends from the plunger 160 to the pan 120. An upper end of the diaphragm 190 is secured to the plunger 160 by being entrapped between the connector 166 of the cap 162 and the receptacle 172 of the skirt 168. A lower end of the diaphragm 190 is secured to the pan 120 by being entrapped between the retaining ring 150 and the recess 142 of the pan 120. In some embodiments, it is contemplated that the membrane 190 may further extend from the receptacle 172 of the skirt 168, through the interior of the skirt 168, and connect to the pan 120 at or near to the center section 132 of the pan 120 or the upper portion 126*a* of the inner sidewall 126.

In some embodiments, it is contemplated that the diaphragm 190 may include a flexible sheet-like material, such as a polymer film, an elastomeric sheet, a plastic sheet, a paper sheet, or a woven cloth. In some embodiments, it is contemplated that the diaphragm 190 may include a crinkly, or creased, material that emits a sound when manipulated.

As shown in FIG. 2, an inner volume 192 of the hand toy device 100 is at least partially defined by the diaphragm 190 and the pan 120. At least a portion of the inner volume 192 is occupied by a granular material 194. Thus, the cover 182 encloses and retains the granular material 194 within the inner volume 192. At least some of the granular material 194 is contained in the trough 122 of the pan 120. In some embodiments, the hand toy device 100 may contain sufficient granular material 194 to fill the trough 122 to an approximate proportion, such as approximately one quarter full, approximately half full, approximately three quarters full, or approximately full.

It is contemplated that the granular material 194 may include any one or more of sand; grit; gravel; salt; sugar; silica; biological particles, such as peppercorns, nuts, seeds, shells, bone particles, or wood chips; rock particles; ceramic particles; crystals; beads; glass particles; plastic particles; metal particles; or other material that produces a tactile feel and/or sound when displaced by an object such as the plunger 160. It is contemplated that the granular material 194 may be configured such that a first portion of the granular material 194 may be readily separated from a second portion of the granular material 194. For example, the granular material 194 may be loose, pulverulent, friable, or otherwise in a condition in which particles of the granular material 194, such as individual grains and/or clumps of grains, may be easily separated from other particles of the granular material 194. In some embodiments, it is contemplated that the granular material 194 may include a substance that promotes agglomeration of the granular material 194. For example, the particles of the granular material 194 may be coated with a binder, a substance that is tacky, or a substance that alters a zeta potential of the granular material 194.

In some embodiments, it is contemplated that as well as, or instead of, the granular material 194, at least a portion of the inner volume 192 may be occupied by a crinkly, or creased, material that emits a sound when manipulated, such as when displaced by an object such as the plunger 160.

As shown in FIG. 2, a depth 204 of the trough 122 as measured parallel to the longitudinal axis 102 from the top 126*c* of the inner sidewall 126 is maximized at the floor 124 of the trough 122. Because of the substantially trapezoidal longitudinal cross sectional shape of the trough 122, the granular material 194 tends to collect at the floor 124 of the trough 122. Furthermore, the skirt 168 of the plunger 160 is aligned with at least part of the floor 124 of the trough 122 in a direction parallel to the longitudinal axis 102. Thus, at least one of the inner sidewall 126 and the outer sidewall 128 promotes settling of the granular material 194 at the floor 124 of the trough 122 and substantially coincident with a path of travel of the plunger 160. Hence, when the plunger 160 is depressed against the force of the biasing member 140 toward the floor, there exists a sufficient depth of granular material 194 in the path of travel of the plunger 160 to yield a tactile feel and/or a sound as the skirt 168 of the plunger 160 engages and displaces the granular material 194.

As shown in FIG. 2, an outer volume 196 of the hand toy device 100 is at least partially defined by the cap 162, the diaphragm 190, and the cover 182. Because the diaphragm 190 retains the granular material 194 in the inner volume 192, the outer volume 196 remains substantially devoid of granular material 194.

Although the hand toy device 100 may take any practicable size and shape, it is contemplated that the hand toy device 100 may be sized and shaped such that the hand toy device 100 may fit in a pocket of a garment, and therefore may be portable. In some embodiments, it is contemplated that the hand toy device 100 may have a height measured along the longitudinal axis 102 that is less than or equal to an overall lateral dimension, such as a diameter, measured perpendicularly to the longitudinal axis 102. In some embodiments, it is contemplated that the hand toy device 100 may have a height measured along the longitudinal axis 102 that is greater than or equal to an overall lateral dimension, such as a diameter, measured perpendicularly to the longitudinal axis 102. It is further contemplated that the hand toy device 100 may be hand-held. For example, a user may hold the hand toy device 100 in the palm of a hand, and may use a thumb of the same hand to actuate the hand toy device 100.

In operation, the hand toy device 100 is held or positioned such that at least a portion of the granular material 194 is contained within the trough 122. The hand toy device 100 may be placed on a surface, such as a table top, a desk top, or a palm of a hand. A user applies a force on the cover 182 of the bonnet 180, such as by a hand or a finger/thumb. The force is generally directed substantially parallel to the longitudinal axis 102 of the hand toy device 100 toward the pan 120. The force is transferred to the cap 162 of the plunger 160 and to the biasing member 140. Thus, the biasing member 140 compresses as the plunger 160 is moved toward the pan 120. When the magnitude of the force exceeds a threshold value, the biasing member 140 compresses sufficiently for the skirt 168 of the plunger 160 to contact and begin to displace a portion of the granular material 194. It is contemplated that the contact produces a first tactile sensation that is communicated to the user via the plunger 160 and the cover 182. It is further contemplated that the contact may also produce a first sound.

In some embodiments, it is contemplated that the end 168*a* of the skirt 168 of the plunger 160 may not be initially in contact with the granular material 194. In other embodiments, it is contemplated that the end 168*a* of the skirt 168 is embedded within the granular material 194 prior to the user applying the force on the cover 182. In such other embodiments, the first tactile sensation and the first sound produced upon the plunger 160 contacting the granular material 194 may be absent.

Motion of the plunger 160 toward the floor 124 of the trough 122 is generally in a direction parallel to the longitudinal axis 102 of the hand toy device 100. Nevertheless, it is contemplated that the motion of the plunger 160 may include an angular displacement of the skirt 168 with respect to the longitudinal axis 102. For example, an interaction between the cap 164 and the biasing member 140 may cause the skirt 168 to become skewed with respect to the longitudinal axis 102. Additionally, or alternatively, the interaction between the cap 164 and the biasing member 140 may promote a side-to-side rocking motion and/or a processing-type motion of the plunger 160 with respect to the longitudinal axis. It is contemplated that each of the above-described motions of the plunger 160 may displace at least of portion of the granular material 194.

When the skirt 168 of the plunger 160 displaces a portion of the granular material 194, the skirt 168 becomes at least partially embedded within the granular material 194 in the trough 122. It is contemplated that such displacement of the granular material 194 produces a second tactile sensation that is communicated to the user via the plunger 160 and the cover 182. Since individual grains of the granular material 194 are displaced by the skirt 168, continued motion of the skirt through the granular material 194 brings the end 168*a* of the skirt 168 into contact with different individual grains of the granular material 194. It is further contemplated that such displacement of the granular material 194 may also produce a second sound. It is contemplated that the second tactile sensation and the second sound may persist for as long as the skirt 168 of the plunger 160 continues to displace a portion of the granular material 194.

It is contemplated that the second tactile sensation may include an intermittently changing magnitude of resistance to the motion of the plunger 160 as particles of the granular material 194 interact with the skirt 168 of the plunger 160, and particularly with the end 168*a* of the skirt 168. For example, the resistance to the motion of the plunger 160 may intermittently increase as the end 168*a* of the skirt 168 approaches the floor 124 of the trough 122 and particles of the granular material 194 become at least momentarily trapped between the end 168*a* of the skirt 168 and the floor 124.

It is contemplated that at least a portion of the granular material 194 may be in contact with the biasing member 140, such that at least a portion of the biasing member 140 is immersed in granular material 194 and the granular material 194 interferes with motion of the biasing member 140. For example, as shown in FIG. 2, at least a portion of the granular material 194 may be present in the bore 136. In such situations, motion of the biasing member 140 with respect to the granular material 194 may produce a third tactile sensation that is communicated to the user via the plunger 160 and the cover 182. It is contemplated that the third tactile sensation may include an intermittently changing magnitude of resistance to motion as particles of the granular material 194 interact with the biasing member 140 and with the bore wall 136. Similarly, such motion of the biasing member 140 may produce a third sound.

It is contemplated that the operation may further include the user reducing the force applied to the cover 182 of the bonnet 180, thereby permitting the biasing member 140 to move the plunger 160 away from the pan 120. Such motion of the plunger 160 may be accompanied by movement of granular material 194 into space previously occupied by the skirt 168. It is contemplated that such displacement of the granular material 194 produces a fourth tactile sensation that is communicated to the user via the plunger 160 and the cover 182 if the user remains in contact with the cover 182. It is further contemplated that such displacement of the granular material 194 produces a fourth sound. It is contemplated that the fourth tactile sensation and the fourth sound may persist at least for as long as the skirt 168 of the plunger 160 remains in contact with a portion of the granular material 194 that is moving. It is contemplated that the fourth tactile sensation may include an intermittently changing magnitude of resistance to motion as particles of the granular material 194 interact with the skirt 168 of the plunger 160, and/or may include an intermittently changing magnitude of resistance to motion as particles of the granular material 194 interact with the biasing member 140 and with the bore wall 136.

It is contemplated that at least one of the first tactile sensation, the second tactile sensation, the third tactile sensation, or the fourth tactile sensation may be similar to at least one other of the first tactile sensation, the second tactile sensation, the third tactile sensation, or the fourth tactile sensation. It is contemplated that at least one of the first tactile sensation, the second tactile sensation, the third tactile sensation, or the fourth tactile sensation may be different from at least one other of the first tactile sensation, the second tactile sensation, the third tactile sensation, or the fourth tactile sensation.

It is contemplated that at least one of the first sound, the second sound, the third sound, or the fourth sound may resemble any one or more of a crackle; a crinkle; a crunch; a crepitation; a crumple; a crush; a tapping sound; a gnashing sound; a grating sound; a mashing sound; a scrunching sound; a scraping sound; a grinding sound; a sound of sand, grit, or gravel being displaced; or an abrasive rubbing sound; among others. It is contemplated that at least one of the first sound, the second sound, the third sound, or the fourth sound may be similar to at least one other of the first sound, the second sound, the third sound, or the fourth sound. It is contemplated that at least one of the first sound, the second sound, the third sound, or the fourth sound may be different from at least one other of the first sound, the second sound, the third sound, or the fourth sound.

It is contemplated that the operation described above may be performed a single time or may include repetition of the above sequence.

The hand toy device 100 is useful for providing a user with tactile and audible stimulation. The tactile feel and/or audible sounds produced by the hand toy device 100 is useful for providing stimulation that soothes, comforts, assists with mental focus, amuses, or otherwise beneficially affects a user. For example, the stimulation may promote an autonomous sensory meridian response.

While the foregoing is directed to embodiments of the present disclosure, other and further embodiments of the disclosure may be devised without departing from the basic scope thereof, and the scope thereof is determined by the claims that follow.

What is claimed is:

1. A hand toy device comprising:

a pan containing granular material;

a plunger movable between a first position in which the plunger is not in contact with the granular material and a second position in which the plunger is in contact with the granular material;

a cover coupled to the pan such that the cover and the pan enclose and retain the plunger and the granular material within the hand toy device when the plunger is in the first and second positions; and a biasing member configured to bias the plunger toward the first position, wherein the pan comprises a trough containing at least a portion of the granular material, the trough aligned with a skirt of the plunger; a diaphragm extending from the plunger to the pan, the diaphragm isolating the granular material from the cover, and wherein the diaphragm is flexible.

2. The hand toy device of claim 1, wherein the cover includes a flexible material.

3. The hand toy device of claim 1, wherein the granular material is configured such that particles of the granular material are readily separable from other particles of the granular material.

4. The hand toy device of claim 1, wherein the granular material includes a substance that promotes agglomeration.

5. The hand toy device of claim 1, wherein the trough is annular, including an inner sidewall and an outer sidewall.

6. The hand toy device of claim 5, wherein at least a portion of one of the inner sidewall and the outer sidewall is at an acute angle with respect to a longitudinal axis of the hand toy device.

7. The hand toy device of claim 5, wherein at least a portion of one of the inner sidewall and the outer sidewall is curved in a plane substantially parallel to a longitudinal axis of the hand toy device.

8. The hand toy device of claim 5, wherein the trough further includes a floor extending from the inner sidewall to the outer sidewall.

9. The hand toy device of claim 1, wherein the skirt is aligned over a floor of the trough such that the skirt is engaged with the granular material when the plunger is in the second position.

10. The hand toy device of claim 1, wherein a volume defined between the cover and the diaphragm is substantially devoid of the granular material.

11. A hand toy device comprising:

a pan including a trough containing a sound-generating material;

a plunger movable between a first position distal from a floor of the trough and a second position proximal to the floor of the trough, the plunger interacting with at least a portion of the sound-generating material to produce a tactile feel when the plunger moves to the second position;

a diaphragm extending from the plunger to the trough, wherein the diaphragm is flexible; a cover coupled to the pan and enclosing the plunger and the sound-generating material within the hand toy device; and a biasing member configured to bias the plunger toward the first position.

12. The hand toy device of claim 11, wherein when the plunger moves to the second position, the plunger interacting with at least a portion of the sound-generating material generates a sound.

13. The hand toy device of claim 11, wherein:

when the plunger is in the first position, a lower end of the plunger is not embedded within the sound-generating material; and when the plunger is in the second position, the lower end of the plunger is embedded within the sound-generating material.

14. The hand toy device of claim 11, wherein the diaphragm isolates the sound-generating material from the cover.

15. The hand toy device of claim 14, wherein the plunger includes a cap and a skirt, the diaphragm coupled to the plunger between the cap and the skirt.

16. The hand toy device of claim 15, wherein:

the trough is annular, the floor extending from an inner sidewall to an outer sidewall; and the diaphragm is coupled to the trough at the outer sidewall.

17. The hand toy device of claim 16, wherein:

the inner sidewall of the trough surrounds a bore; and the biasing member is at least partially disposed in the bore.

18. The hand toy device of claim 14, wherein:

the cover encloses the diaphragm; and a volume defined between the cover and the diaphragm is substantially devoid of the sound-generating material.

19. The hand toy device of claim 11, wherein the sound-generating material is granular.

20. The hand toy device of claim 11, wherein the cover and the pan enclose the sound-generating material within the hand toy device when the plunger is in the first and second positions.

* * * * *